United States Patent [19]

Robertson et al.

[11] Patent Number: 4,502,848

[45] Date of Patent: Mar. 5, 1985

[54] EXHAUST GAS OPERATED VACUUM PUMP ASSEMBLY

[75] Inventors: Gerald F. Robertson, Mt. Clemens; Donald J. Pozniak, Utica, both of Mich.

[73] Assignee: General Motors Corporation, Detroit, Mich.

[21] Appl. No.: 427,652

[22] Filed: Sep. 29, 1982

[51] Int. Cl.[3] ..... F04B 35/00; F04B 39/00

[52] U.S. Cl. ..... 417/380; 91/409; 92/85 B; 417/399; 417/401

[58] Field of Search ..... 92/85 B, 130 B, 134, 92/143; 91/409, 408; 417/401, 380, 399

[56] References Cited

U.S. PATENT DOCUMENTS

| | | | |
|---|---|---|---|
| 1,993,230 | 3/1935 | Taylor | 417/401 X |
| 2,142,329 | 1/1939 | Nika, Jr. et al. | 417/401 X |
| 3,106,821 | 10/1963 | Ridgway | 60/30 |
| 3,238,886 | 3/1966 | Johnson | 103/150 |
| 3,244,357 | 4/1966 | Bunker | 230/52 |
| 3,250,224 | 5/1966 | Phillips et al. | 103/150 |
| 3,303,756 | 2/1967 | Geeson | 92/143 X |
| 3,321,977 | 5/1967 | Topham | 417/401 X |
| 3,339,830 | 9/1967 | Graham | 230/52 |
| 3,990,351 | 11/1976 | Sundin | 92/85 B |
| 4,083,290 | 4/1978 | Andres | 91/409 X |
| 4,156,416 | 5/1979 | Weisgerber et al. | 123/196 R |

FOREIGN PATENT DOCUMENTS

| | | | |
|---|---|---|---|
| 717802 | 10/1931 | France | 417/380 |

*Primary Examiner*—Irwin C. Cohen
*Attorney, Agent, or Firm*—William A. Schuetz

[57] ABSTRACT

A vacuum pump assembly which is driven by pulsating exhaust gases emanating from an internal combustion engine is disclosed. The pump assembly includes a double-acting pump means for pumping air from a vacuum source and having a reciprocable pumping member, an actuating means including a reciprocable actuating member drivingly connected to the pumping member and which is driven through first and second strokes to move the pumping member through first and second strokes, respectively, one side of the actuating member being in communication with the exhaust gases and with the actuating and pumping members being movable through their first strokes during the pressure increasing phase of each pressure pulsation and being moved through their second strokes by a nonlinear variable rate air spring means during each pressure decreasing phase of each pressure pulsation. The air spring means is in communication with the atmosphere via bleed hole means and with the latter being uncovered during low engine speeds and loads, being covered and uncovered by the reciprocating actuating member during intermediate engine speeds and loads and being covered during high engine speeds and loads whereby the pump assembly is operable to pump air from the vacuum source throughout a wide range of engine speeds and loads including high speeds and loads.

4 Claims, 7 Drawing Figures

EXHAUST GAS OPERATED VACUUM PUMP ASSEMBLY

The subject matter of the present application is related to that of two co-pending applications filed concurrently herewith in the names of Donald Pozniak, Gerald Robertson and Michael McClain; and one co-pending application filed concurrently herewith in the name of Michael McClain, and assigned to the same assignee as the present application and identified by Ser. No. 427,651, Ser. No. 427,650, now U.S. Pat. No. 4,479,765, and Ser. No. 427,666, now U.S. Pat. No. 4,459,088.

The present invention relates to a pump assembly and more particularly to a vacuum pump assembly which is actuated by exhaust gas pressure pulsations emanating from an internal combustion engine.

Current production automotive vehicles contain many pneumatically operated controls and devices, such as power-assist brakes, cruise controls, controls for air conditioning and heating and EGR valves. Proper operation of these controls or devices requires a source of vacuum, which historically has been taken from the intake manifold of an internal combustion engine used to power the vehicle. The pneumatically operated controls or devices have proved to be relatively inexpensive and reliable when there is sufficient intake manifold vacuum. However, with the introduction of the smaller, fuel efficient automobiles having smaller engines, the level of vacuum in the intake manifold has decreased to the point where it no longer can be relied upon to operate reliably all of the pneumatically operated controls or devices, especially the power-assist brakes, throughout the entire range of speed and load of the engine. Consequently, if inexpensive pneumatically operated controls or devices are to be retained in smaller vehicles, it is imperative that a source of vacuum other than the intake manifold be used.

Currently, the assignee of the present invention produces vacuum pump assemblies for providing such a reliable source of vacuum. One such pump assembly has a reciprocable pumping member which is actuated through one stroke via an eccentric cam driven from the crankshaft of the engine and moved through its other or return stroke via a spring means. This pump assembly is substantially like that shown in U.S. Pat. No. 4,156,416, issued May 29, 1979, and assigned to the same assignee of the present invention. Another such pump assembly is similar to that of the above-mentioned U.S. patent, but is driven by an electric motor through an eccentric drive rather than by the engine crankshaft. While both of these pump assemblies have been highly satisfactory in operation, they have the drawback that they must be driven either by the engine of the vehicle or by a separate electric motor.

To overcome the use of vacuum pump assemblies which are either driven from the engine or driven by a separate electric motor, this and two (three) co-pending patent applications filed concurrently herewith in the names of Michael J. McClain, Donald J. Pozniak and Gerald F. Robertson and assigned to the same assignee as the present invention, disclose using the exhaust gases emanating from the internal combustion engine for operating or actuating novel vacuum pump assemblies. The advantage of using the exhaust gases as the motive force to operate the vacuum pump assemblies is that it provides a "free" or nonparasitic energy source which does not in any way affect or detract from the operation of the internal combustion engine or does not require a further drain on the electrical system of the automotive vehicle.

At this point, it should be noted that diaphragm operated fuel pumps have heretofore been provided which are actuated by pressure pulsations taken from either the intake manifold or the crankcase of an engine. Examples of such pumps are shown in U.S. Pat. Nos. 3,238,886 and 3,250,224. It is also known to provide reciprocating pumps for pumping a fluid which are reciprocated by a separate actuating means drivingly connected thereto, the actuating means including a reciprocable diaphragm whose opposite sides are alternately exposed to vacuum from the intake manifold of an engine. Examples of such pump assemblies are illustrated in U.S. Pat. Nos. 3,244,357 and 3,339,830. It is also known to use the pressure pulsations in the exhaust gases emanating from an internal combustion engine to deflect a diaphragm to cause air to be pumped or drawn into the exhaust gases prior to entering an afterburner, as shown in FIG. 1 of U.S. Pat. No. 3,106,821. While FIG. 1 of the latter patent shows a diaphragm operated air pump actuated by the pressure pulsations in the exhaust gases from an internal combustion engine, it has been found that the pump there shown would not be operable over the full range of engine speeds and/or loads, especially at high speeds and/or during wide open throttle conditions.

As noted in the above reference to co-pending patent applications filed concurrently herewith, studies of the pressure profiles of exhaust gases generated by a multi-cylinder internal combustion engine show that the exhaust gases emanate as pressure pulsations whose pressure, frequency and amplitude, when approximated to a cyclic sine wave, vary greatly in accordance with engine speed and operating conditions. The frequency of the cyclic operation is typically on the order of 30 Hertz to 150 Hertz. The amplitude of the pressure pulsations is great enough so that subatmospheric pressures exist in each cyclic exhaust gas pulsation for a short period of each cycle even though the average pressure of the cycle is substantially above atmospheric pressure. In typical internal combustion engine exhaust systems, these subatmospheric pressure periods occur to varying degrees during low through medium or high engine speeds, but disappear at high engine speeds and/or loads where the pressure pulsations during their entire cycle are above atmospheric pressure.

It is an object of the present invention to provide a new and improved vacuum pump assembly for pumping a fluid, which is actuated by pressure pulsations in the exhaust gases from an internal combustion engine and which has a novel non-linear variable rate air spring means whereby the pump assembly is operable to pump fluid over a wide range of engine speeds including high speed engine operation.

Another object of the present invention is to provide a new and improved vacuum pump assembly, as defined in the preceding object, and in which the pump assembly is operative to pump fluid during low engine speeds and/or light loads when a portion or period of the pressure pulsations is below atmospheric pressure and during high engine speeds and/or high loads when the pressure pulsations are wholly above atmospheric pressure during their entire cycle.

Yet another object of the present invention is to provide a new and improved vacuum pump assembly, as defined in the preceding objects, and wherein the pump assembly includes a pump means for pumping air from a vacuum source and having a reciprocable pumping member movable through first and second strokes, an actuating means including a housing and a reciprocable actuating member connected to the pumping member and which is adapted to be driven through first and second strokes to move the pumping member through its first and second strokes, respectively, and wherein the reciprocated actuating member of the actuating means divides the housing into a pair of chambers, one of which is in communication with the pulsating exhaust gases and the other of which defines with a bleed hole means in the housing a variable rate air spring means, and wherein the actuating member during low engine speeds is spaced from one side of the bleed hole means and has a displacement during its strokes such that the bleed hole means remains uncovered, during medium engine speeds has a longer displacement during its strokes such that the bleed hole means is alternately covered and uncovered and during high engine speeds is located on the other side of the bleed hole means and has a displacement during its stroke such that the bleed hole means is at all times covered whereby the air spring means functions as a single non-linear variable rate air spring means to effect movement of the actuating member through its second strokes during low, medium and high engine speeds and/or loads.

A further object is to provide a new and improved vacuum pump assembly as defined in the next preceding object, and wherein said pump means is a double-acting pump means in which the reciprocable pumping member causes air to be pumped from a vacuum source during both strokes thereof.

The present invention further resides in various novel constructions and arrangement of parts, and further objects, novel characteristics and advantages of the present invention will be apparent to those skilled in the art to which it relates and from the following detailed description of the illustrated, preferred embodiments thereof made with reference to the accompanying drawings forming a part of this specification and in which similar reference numerals are employed to designate corresponding parts throughout the several views, and in which.

The present invention provides a novel pump assembly and in particular a novel vacuum pump assembly which is actuated by pressure pulsations in exhaust gases emanating from an internal combustion engine.

Figure 1:
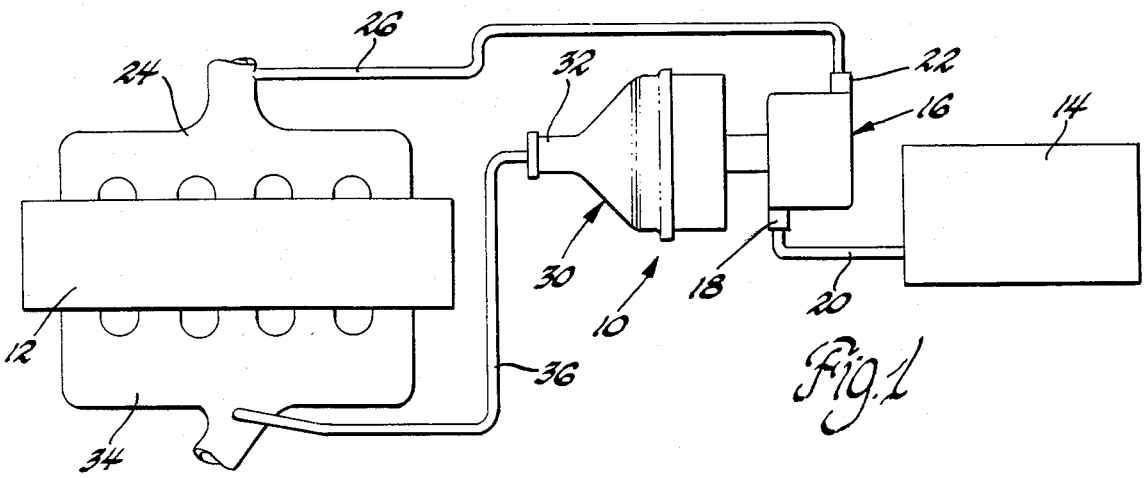
FIG. 1 is a schematic diagram illustrating the novel vacuum pump assembly of the present invention and its interconnection with an internal combustion engine and a vacuum source.

Referring to the schematic diagram of FIG. 1, a vacuum pump assembly 10 is there schematically shown as being interconnected with an internal combustion engine 12 and a vacuum source 14. The vacuum pump assembly 10 includes a pump means 16 whose inlet 18 is connected with the vacuum source 14 via a conduit 20 and whose outlet 22 is connected with an intake manifold 24 of the internal combustion engine 12 via a conduit 26. The pump means 10 also includes an actuating means 30 having an inlet 32 which is in communication with an exhaust gas manifold 34 of the internal combustion engine 12 via a conduit 36.

The internal combustion engine 12, as diagrammatically illustrated in FIG. 1, is a four-cylinder internal combustion engine. It should be understood, however, that other size multi-cylinder engines could be employed. The vacuum source 14 is illustrated as being a reservoir having a predetermined volume. It should be understood, however, that instead of the reservoir, the vacuum source could be a conventional brake booster housing, and/or the combined volumes necesssary to operate an EGR valve, cruise control, or any other pneumatically operated control or device requiring a vacuum pressure.

It should be noted at this point that studies of the pressure profiles of exhaust gases for a multi-cylinder internal combustion engine show that the exhaust gases emanate as pressure pulsations whose pressure, frequency and amplitude, when approximated to a cyclic sine wave, vary greatly in accordance with engine speed and operating conditions. The pressure profiles will also vary somewhat in accordance with the size and number of cylinders of the internal combustion engine, the configuration of the exhaust system and the location within the exhaust system where the pressure profiles are measured. In the illustrated schematic view of FIG. 1, the exhaust gas pressure pulsations for use with the novel pump assembly 10 are preferably taken from a location adjacent the outlet of the exhaust gas manifold 34. It will, of course, be understood that in some pump applications other locations for picking up exhaust gas pressure pulsations may be more desirable.

It has been found that the frequency of the cyclic operation of exhaust gas pressure pulsations is typically on the order of 30 to 150 Hertz. The amplitude of the pressure pulsations is great enough so that subatmospheric pressures exist during a portion or short period of each cycle of the exhaust gas pulsations even though the average pressure during the cycle is substantially above atmospheric pressure. In typical internal combustion engine exhaust systems, the subatmospheric pressure periods occur to varying degrees during most engine speeds and/or loads, but disappear entirely at higher engine speeds wherein the pressure pulsations during their entire cycle are at above atmospheric pressure.

Figure 2A:
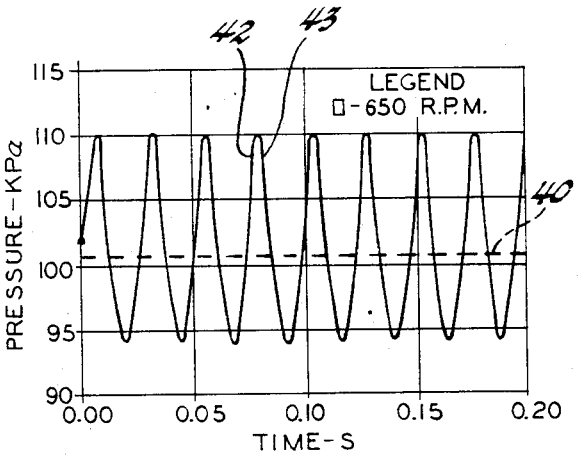
FIGS. 2A through 2D are graphs of exhaust gas pressure profiles, when approximated to a cyclic sine wave, of exhaust gases of an internal combustion engine at different engine speeds.
Figure 2B:
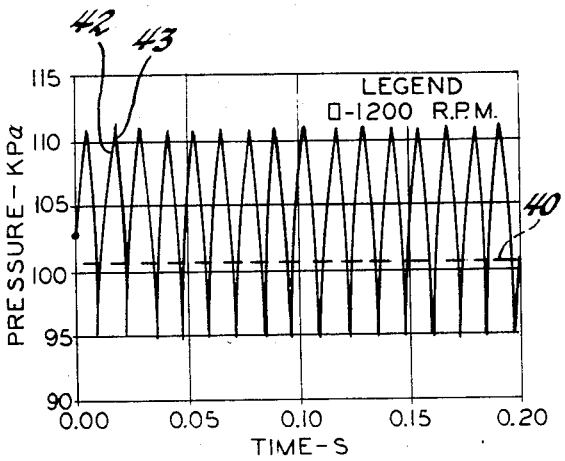
Figure 2C:
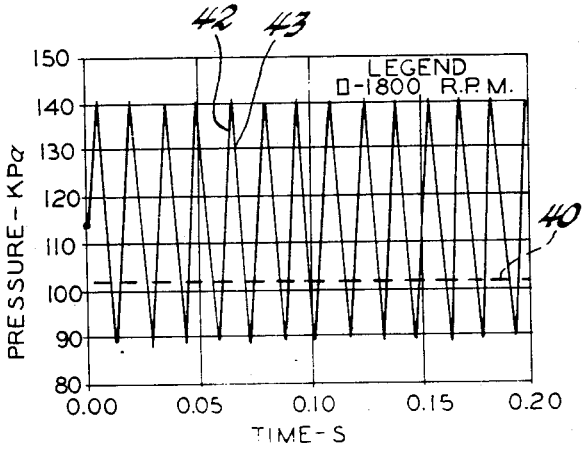
Figure 2D:
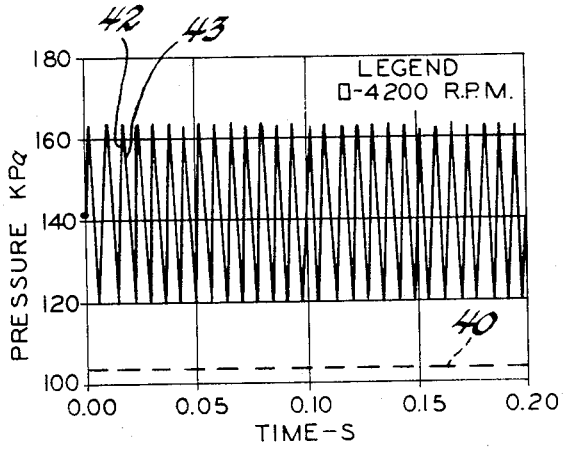

As an illustrative example, FIGS. 2A through 2D show the exhaust gas pressure profiles, when approximated to a sine wave, of the exhaust gases of a 2.5 liter four-cylinder internal combustion engine. FIG. 2A illustrates the exhaust gas pressure profile at idle (approximately 650 rpm) and low load, FIG. 2B illustrates exhaust gas pressure profile at approximately 1200 rpm and one half full load, FIG. 2C illustrates exhaust gas pressure profile at approximately 1800 rpm and full load, and FIG. 2D shows the exhaust gas pressure profile at approximately 4200 rpm and full load or wide open throttle. The vertical side of each of the graphs illustrates the pressure in kPA and the horizontal side indicates time in seconds. Atmospheric pressure is at approximately 101 kPA as is illustrated by the horizontally extending dotted line 40 on each of the graphs 2A to 2D.

As can be seen from FIG. 2A, the exhaust gas pressure pulsations at approximately idle speed have an amplitude which varies between 95–110 kPA and a frequency of approximately two cycles for each 0.05 seconds. At approximately 1200 rpm (FIG. 2B), the pressure variance in the pressure pulsations remains approximately the same as it was at idle speed, but the frequency of the pressure pulsation cycles is approximately twice that experienced at idle speed. At 1800 rpm (FIG. 2C), the pressure of the pressure pulsations varies between approximately 90–140 kPA, but the frequency of the pulse cycle decreases slightly from that shown at 1200 rpm (FIG. 2B). At 4200 rpm (FIG. 2D), the pressure pulsations vary between approximately 120–160 kPA and the frequency of the pulse cycles is approximately double that shown at 1800 rpm (FIG. 2C).

Each cycle for each pressure pulsation can be defined as having a pressure increasing phase 42 and a pressure decreasing phase 43 and with each cycle constituting a single frequency. As can be seen from the graphs of 2A to 2C, for each cycle of operation of each pressure pulsation, a portion or short period of each cycle occurs at a pressure which is below atmospheric pressure as indicated by the dotted line 40. These subatmospheric pressure periods occur to a progressively lesser degree as the engine speeds increases up to an engine speed of approximately 1800 rpm. But, as the graph of FIG. 2D illustrates, such subatmospheric pressure periods totally disappear at high engine speeds and/or loads, such as at 4000–4200 rpm. At engine speeds somewhat higher than 1800 rpm to maximum, the entire cycle of operation for each pressure pulsation takes place at a pressure substantially above atmospheric pressure.

From the above, it should be apparent that in order to utilize exhaust gas pressure pulsations as the motive force to operate the vacuum pump assembly 10 over a wide range of engine speeds and loads, the pump assembly 10 must be designed to operate even though the pressure of the pressure pulsations varies widely and must operate during engine speeds and loads when the pressure pulsations include subatmospheric periods and when the pressure pulsations during their entire cycle are wholly above atmospheric pressure.

Figure 3:
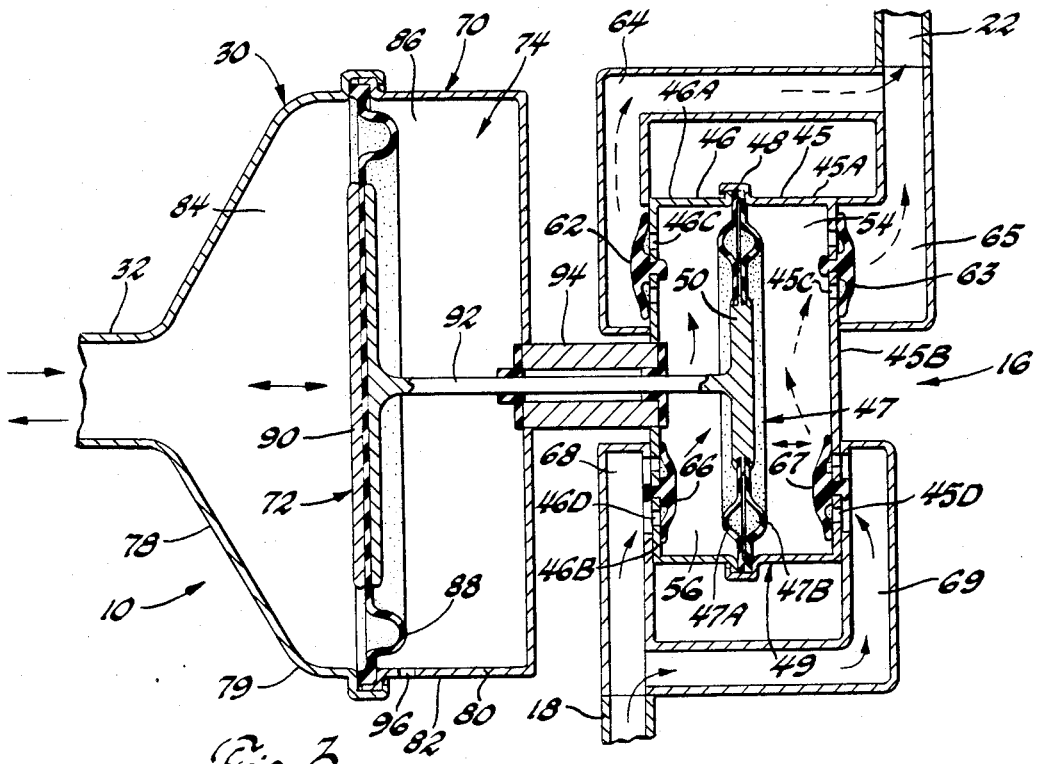
FIG. 3 is a schematic view with part shown in section and part shown in elevation of the preferred embodiment of the novel pump assembly of the present invention.

Referring to FIG. 3, a preferred embodiment of the novel pump assembly 10 is thereshown. The pump assembly 10 comprises the pump means 16 for pumping air from the vacuum source 14 to the intake manifold 24. The pump means 16 is a double-acting pump and comprises a pair of cup-shaped pump housings 45 and 46 and a diaphragm assembly 47. The cup-shaped pump housings 45 and 46 are stamped from sheet metal and respectively include cylindrical side walls 45A and 46A and bottoms 45B and 46B at one end of the side walls 45A and 46A. The side walls 45A and 46A adjacent their free ends are suitably crimped together, as indicated by reference numeral 48 and together define a housing means 49.

The diaphragm assembly 47 includes a pair of oppositely facing juxtaposed flexible diaphragms 47A and 47B which are sealably secured at their inner periphery to an annular rigid plate or member 50 and at their outer ends periphery sealably secured between the adjacent crimped ends of the side walls 45A and 46A of housings 45 and 46. The diaphragm assembly 47 divides the pump housing means 49 into a pair of chambers 54 and 56.

Communication between pump chambers 56 and 54 and outlet conduit 26 via outlet 22 is controlled by a one-way check valve means 62 and 63 via conduit or passageway means 64 and 65, respectively. To this end, the bottom 46B of the housing 46 has openings 46C therethrough and carries the check valve means 62. The check valve means 62 is in the form of a flexible umbrella valve having a stem secured to the bottom wall 46B and a cover overlying the openings 46C. The umbrella valve 62 is made from a suitable elastomeric material and is self-biased toward a position in which it overlies openings 46C to seal chamber 56 from communication with passageway means 64, but is deflectable to an open position to allow fluid to flow from chamber 56 to passageway means 64 when the pressure in chamber 56 exceeds the pressure in the passageway 64 and outlet 22. Likewise the bottom wall 45B of the housing 45 has openings 45C therethrough and carries the check valve means 63. The openings 45C and check valve means 63 are identical to the openings 46C and check valve means 62. The check valve means 63 is self-biased toward a closed position in which it overlies the openings 46C to seal chamber 54 from communication with passageway means 65, but is deflectable to an open position to allow fluid to flow from chamber 54 to passageway means 65 when the pressure in chamber 54 is greater than the pressure in passageway 65 and the outlet 22.

Communication between the pump chambers 54, 56 via inlet 18 is controlled by a one-way check valve means 66 and 67 via passageway means 68 and 69, respectively. To this end, the bottoms 46 and 45B of the housings 46 and 45 have openings 46D and 45D therethrough and carry the check valve means 66 and 67, respectively. The check valve means 66 and 67 are identical to the check valve means 62 previously described. The check valve means 66 is self-biased toward a closed position in which it overlies the openings 46D to prevent communication between the passageway means 68 and chamber 56, but is deflectable to an open position to allow fluid to flow from conduit 20 through inlet 18 via passageway means 68 into chamber 56 when the pressure at the inlet 18 exceeds the pressure in chamber 56. The check valve means 67 is self-biased to a closed position in which it overlies the openings 45D to prevent communication between chamber 54 and the inlet 18 via passageway means 69, but is deflectable to an open position to allow fluid to flow from inlet 18 via passageway means 69 into chamber 54 when the pressure at the inlet 18 exceeds the pressure in chamber 54. Although FIG. 3 only schematically illustrates one check valve for each of the check valve means 62, 63, 66 and 67, it should be understood that a plurality of such check valves could be employed to obtain the desired flow rate through their associated openings.

Figure 4:
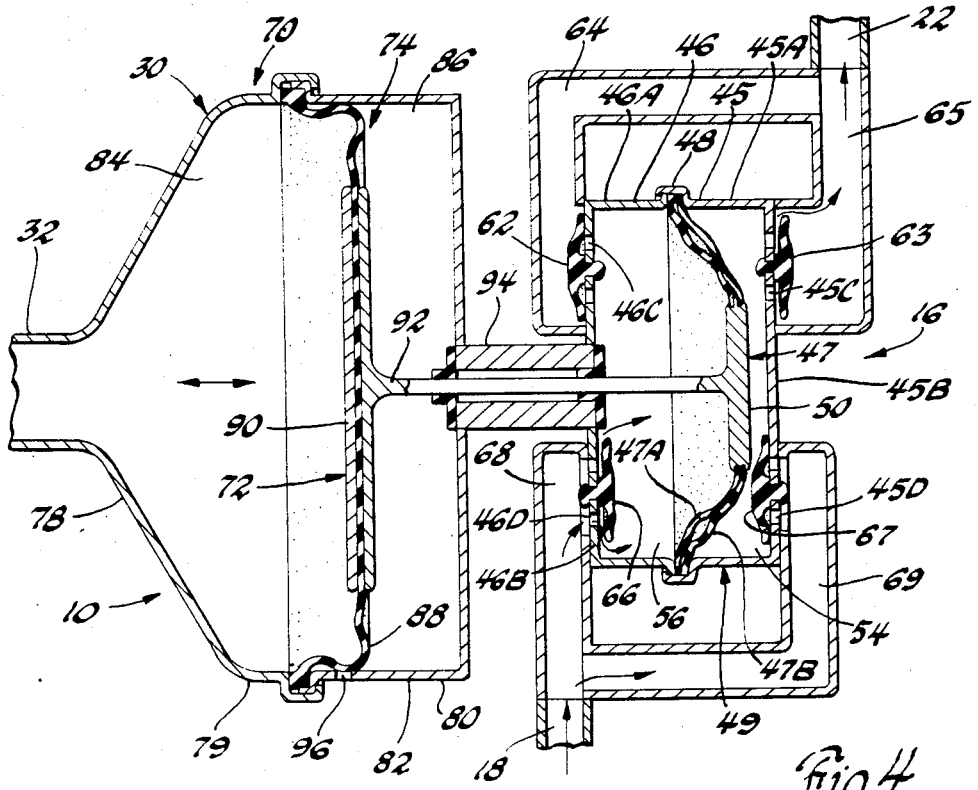
FIG. 4 is a view substantially identical to that shown in FIG. 3, but showing different parts in different positions.

It should be apparent from the above that when the diaphragm assembly 47 is moved through its first stroke or to the right from a position as shown in FIG. 3, toward a position as shown in FIG. 4, the pressure in chamber 54 will increase and the pressure in chamber 56 will decrease. During this movement, the check valve means 66 will open to allow fluid to flow from conduit 20 through inlet 18 via passageway means 68 into chamber 56 and at some point during the rightward movement through the first stroke of the diaphragm assembly 47 the check valve means 63 will open to allow fluid to be expelled from chamber 56 into passageway means 65 and thence to outlet 22 and conduit 26. During this movement no flow of fluid from chamber 56 can flow into passageway means 64 and thence to outlet 22 and no fluid can flow from chamber 54 to passageway means 69 and inlet 18 because the check valve means 62 and 67 will at all times be in their closed position due to the differential pressure thereacross.

When the diaphragm assembly 47 is moved through its second stroke or toward the left from a position as shown in FIG. 4 toward a position as shown in FIG. 3, the pressure in chamber 56 will increase and the pressure in chamber 54 will decrease. This will cause the check valve means 63 to be moved toward its closed position and prevent communication between inlet 18 via passageway means 65 and the chamber 54 and will also cause check valve means 66 to be moved toward its closed position to prevent communication between outlet 22 via passageway means 68 and the chamber 56. However, during this leftward movement, fluid will flow from chamber 56 via the check valve means 62 to passageway means 64 and thence to outlet 22. That is, when the pressure in chamber 56 exceeds the pressure in passageway means 64, the check valve means 62 will open to allow fluid to flow from chamber 56. During this leftward movement of the diaphragm assembly 47, fluid will also flow from inlet 18 via passageway means 69 past check valve means 67 into chamber 54. That is, as the pressure in chamber 54 decreases below the pressure in passageway means 69, the check valve means 67 will move toward an open position.

It should be noted at this point, that the diaphragm assembly 47 could be replaced by a reciprocable piston assembly having an outer annular seal which slidably engages a cylindrical sleeve or liner located inside of the cylindrical housing portions 46A and 45A of the housing means 49.

The diaphragm assembly 47 is adapted to be reciprocated through its first and second strokes by the actuating means 30. The actuating means 30 comprises a housing means 70, a diaphragm assembly 72 drivingly connected with the diaphragm assembly 47 and a variable rate spring means 74. The housing means 70 is stamped from sheet metal and comprises a generally frusto-conically shaped housing member 78 whose annular side wall 79 adjacent its open or wide end is suitably crimped to a cylindrically shaped side wall 80 of a cup-shaped housing member 82. The diaphragm assembly 72 divides the housing means 70 into a pair of chambers 84 and 86 and includes a flexible diaphragm 88 whose outer periphery is clamped between the housing members 78 and 82 and whose inner periphery is secured to a rigid annular member 90. The rigid member 90 is drivingly connected to the rigid member 50 of the diaphragm assembly 47 of the pump means 16 by a shaft or rod 92. The shaft 92 is slidably received in an annular bearing means 94 whose opposite ends, as depicted in FIG. 3, are secured to the housings 82 and 46. The bearing means 94 includes suitable bearing surfaces or bearings and suitable shaft seals and slidably receives the shaft 92 for easy reciprocable movement in opposite directions.

The chamber 86 of the air spring means 74 has a volume defined by the housing 82, diaphragm assembly 72 and shaft 92. The air spring means 74 also includes a bleed hole means 96 in the side wall 80 of the housing 82. The bleed hole means 96 has a predetermined area and vents the chamber 86 to the ambient atmosphere. The bleed hole means 96 is also spaced or located a predetermined distance from the right side of the diaphragm assembly 72, as viewed in FIG. 3. Although the bleed hole means 96, in the illustrated embodiment shown in FIGS. 3 and 4 is shown as a single hole of a given area which, as hereinafter more fully described, is adapted to be covered and uncovered by the diaphragm 88, it should be understood that a plurality of axially spaced holes in the side wall 80 could be provided so that the diaphragm 88 successively covers and uncovers the bleed holes.

The chamber 84 of the actuating means 30 is at all times in communication with the exhaust gases of the internal combustion engine 12 via the conduit 36 and the inlet 32, the latter shown as being formed integral with the housing 78.

Based on studies using a mathematical model, the approximate dimensions of the pump assembly components for a design appropriate for a typical four-cylinder engine for use with a passenger car are as follows:

Diameter of diaphragm assembly 72=0.1015 meters.

Diameter of reciprocable diaphragm assembly 47=0.0507 meters.

Flow areas of the check valve means 62, 63, 66 and 67=0.0001556 meters$^2$.

Volume of chamber 84=0.000181 meters$^3$.

Volume of chamber 56 (initial)=0.0000545 meters$^3$.

Volume of chamber 54 (initial)=0.0000546 meters$^3$.

Volume of chamber 86 (initial)=0.000074 meters$^3$.

Bleed hole 96 flow area=0.00000314 meters$^2$.

Bleed hole location=closed at all rightward diaphragm assembly 72 displacements greater than 0.006 meters from its center position, as shown in FIG. 3.

In operation, as exhaust gases flow from the exhaust gas manifold 34 a portion thereof will be directed via conduit 36 to inlet 32 and enter chamber 84 of the actuating means 30. Since the exhaust gases emanate as pressure pulsations, the latter during their pressure increasing phase of each pulse cycle will act on the diaphragm assembly 72 to cause movement of the latter toward the right or through its first stroke, as viewed in FIG. 3, and in opposition to the biasing force of the air spring means 74. When the sum of the pressures in volume 84 times the area of the diaphragm assembly 72 and the pressure in volume 56 times the area of the diaphragm assembly 47 is greater than the sum of the pressures in chamber 54 times the area of the diaphragm assembly 47, the pressure in chamber 86 times the diaphragm assembly 72 and any friction and resistance to movement, then the diaphragm assembly 72 will tend to move rightward through its first stroke and cause an increase in the pressure of chamber 54 and a decrease in the pressure of chamber 56. This rightward movement of the diaphragm assemblies 72 and 47 toward the right through their first strokes will cause the check valve 66 to open to cause fluid to be drawn from conduit 20 via passageway means 68 into chamber 56 and cause check valve 63 to open to cause fluid from chamber 54 to be expelled into passageway means 65 and outlet 22. This rightward movement of the diaphragm assemblies 47 and 72 continues during the pressure increasing phase of the pulse cycle until the peak pressure is reached. At that point the pressure in chamber 84 begins to decrease as the pulse cycle begins its pressure decreasing phase. It should be noted at this juncture that whenever the diaphragm assemblies 47 and 72 are moved through their strokes that some slight additional movement will normally take place beyond their position at the time the pulse cycle is at its peak or bottom. This is due to inertia forces or effects acting on the assemblies 47 and 72 and the piston rod 92. For the sake of brevity, this inertia effect will not be repeated in the operational description of the pump assembly 10 which follows.

During the pressure decreasing phase of each pressure pulsation or cycle, the air spring means 74 will begin to move the diaphragm assembly 72 and 47 toward the left or through its second stroke, as viewed in FIG. 3. This leftward movement occurs when the sum of the pressures exerted by the air spring means 74, the pressure in chamber 86 times the area of the diaphragm assembly 72 and the pressure in chamber 54 times the area of the diaphragm 47 exceeds the sum of the pressures in chamber 56 times the area of the diaphragm assembly 47 and the pressure in chamber 84 times the area of the diaphragm assembly 72 and any frictional resistance to movement. As the diaphragm assemblies 72 and 47 move toward the left, check valve 66 will move to its closed position to prevent further communication between inlet conduit 20 and chamber 56, the check valve 63 will move to its closed position to prevent communication between the outlet 22 and the chamber 54, check valve 67 will move from a closed position to an open position to cause fluid to flow from inlet 18 to chamber 54 via passageway means 69 and check valve means 62 will move from a closed position to an open position to expel fluid from chamber 56 to outlet 22 via passageway means 64. This movement continues until the decreasing pressure phase of each pressure pulsation or cycle reaches its lowest value. The above operation will repeat itself during each pressure pulsation of the exhaust gases.

From the foregoing, it can be seen that the pump means 16 is a double-acting pump means in which fluid is alternately drawn into and expelled from the pump means 16 during each stroke of the pump means 16.

It should be noted that leftward movement of the diaphragm assemblies 72 and 47, as viewed in FIG. 3, is aided during the decreasing pressure phase portion of each pulsation when the latter is at subatmospheric pressure. This is because the pressure in chamber 86 times the area of the diaphragm assembly 72 will exceed the pressure in chamber 84 times the area of the diaphragm assembly 72 and thus, leftward movement is aided as a result of the subatmospheric period during the pressure pulses. As noted hereinbefore, these subatmospheric periods of each pressure pulsation occur during engine speeds up to and somewhat above 1800 rpm. This, however, does not occur at high engine speeds and loads where the pressure of the pressure pulses is at all times above atmospheric pressure.

It is also important to note that during low through moderate speed operations of the engine 12, the pressures of the exhaust gas pressure pulsations are such that the diaphragm assembly 72 is deflected rightward and leftward through strokes having an amplitude or displacement such that the deflection takes place adjacent the left end and middle of the actuating means 70, as viewed in FIG. 3 and that the diaphragm assembly 47 is reciprocated back and forth through a displacement adjacent the left end and center of the pump housing means 49. Thus during these conditions of operation, the pump means 16 operates to pump a major portion of the fluid being pumped through the chamber 56 and a minor portion of the fluid through chamber 54. Also during these conditions of operation the resistance of the air spring means 74 is light due to the open bleed hole means 96 so as to allow the diaphragm assembly 72 to be flexed through a sufficient displacement stroke to effect a pumping action which is sufficient to supply the needed vacuum to the vacuum source 14 at moderate engine speeds and to supply sufficient vacuum in conjunction with the vacuum of the intake manifold at idle or low engine speeds.

The resistance of the air spring means 74 is light during low to moderate engine speeds because the displacement stroke of the diaphragm assembly 72 is such that the entire stroke takes place to the left of the bleed hole means 96. This leaves the bleed hole means 96 uncovered at all times and hence, the chamber 86 remains in communication with the atmosphere to allow the air in the chamber 86 to be expelled through the bleed hole means 96 during the movement of the diaphragm assembly 72 toward the right.

When the engine of the internal combustion engine 12 is operating during a medium range of engine speeds and loads, such as 1800 rpm, the pressure of the pressure pulsations will be increased over that at low or moderate engine speeds. During such engine speed operation, the diaphragm assemblies 72 and 47 will be deflected toward the right and left through displacement strokes which are at or near their maximum strokes and the diaphragm assembly 72 during the last portion of its first or rightward stroke will cover the bleed hole means 96 and thus trap the air within the chamber 86. This causes the pressure within the chamber 86 to rise and hence, cause the resistance of the air spring means to increase in a non-linear fashion. This increasing pressure of the air spring means 74 affects return movement of the diaphragm assembly 72 through its second or leftward stroke in which it uncovers the bleed hole means 96 after moving through a first portion of its second stroke. During medium speed engine operation, the diaphragm assemblies 72 and 47 are moved through their maximum or near-maximum displacement and pumping action takes place alternately from both chambers 54 and 56 at approximately an equal rate.

During high speed operation of the engine 12, such as at 4000–4200 rpm, the diaphragm assembly 72 will be displaced rightwardly to at all times cover the bleed hole means 96 and the entire displacement of the strokes will take place to the right of the bleed hole means 96, as viewed in FIG. 4. The displacement of the diaphragm assemblies 72 and 47 during high speed and load operation is less than at medium speed operation and the air spring means 74 operates to exert a relatively stiff or higher biasing force against rightward movement of the diaphragm assembly 72. During this mode of operation, the diaphragm assemblies 72 and 47 are reciprocated back and forth adjacent the right end of their respective housings 70 and 49, as shown in FIG. 4, since the exhaust gas pressures are at all times above atmospheric pressure. The major portion of the pumping effort during high engine speed and load operation takes place through chamber 54 and only a minor portion takes place through chamber 56.

It should be noted that the variable rate air spring means 74 is an important feature of the present invention in that it provides little resistance to movement of the diaphragm assembly 72 through its first strokes during low to moderate engine speeds and loads. This allows the pump means 16 to operate at a sufficient displacement stroke during these speeds and loads so as to enable a good pumping action to be obtained. However, at medium and higher engine speeds and loads, the force exerted by the spring means 74 progressively increases so that it can cause movement of the diaphragm assembly 72 through its second stroke even though the exhaust gas pulsations are primarily or at all times above atmospheric pressure. The area and location of the bleed hole means 96 and the volume of the air spring means 74 is chosen such that little resistance to deflection of the diaphragm assembly occurs during a first given linear distance of deflection and then the resistance to further deflection upon further linear deflection progressively and steeply increases at a non-linear rate.

From the foregoing, it should be apparent that a novel pump assembly 10 has been provided which can be driven by the exhaust gases of an internal combustion engine throughout a wide range of engine operating speeds and that by the inclusion of the novel variable rate air spring means 74, the pump means 16 will operate irrespective of whether the pressure pulsations include any portion in their cycles which is at a pressure below atmospheric or whether the pressure pulsations at all times during their cycles of operation are at above atmospheric pressure.

While the novel pump assembly of the present invention has been described as being used as a vacuum pump assembly for use with internal combustion engines, it should be apparent to those skilled in the art that the novel pump assembly could be used to pump a fluid under positive pressure, such as compressed air, etc. Examples of such uses would be for providing compressed air for air shocks or air springs in leveling controls and/or for use in pumping a liquid washer fluid onto a windshield or headlamp of an automobile.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property or privilege is claimed are defined as follows:

1. In combination, a pump assembly and an internal combustion engine which generates exhaust gases having pressure pulsations of varying pressure and amplitude at different engine speeds and with portions of the amplitude being at subatmospheric pressure at low engine speeds and with said amplitudes being wholly above atmospheric pressure at high engine speeds, said pump assembly comprising:

a pump means for pumping a fluid and including a reciprocable pumping member movable through first and second strokes, an actuating means including a housing, and a reciprocable actuating member movable through first and second strokes and which is drivingly connected to said pumping member to move the same through its first and second strokes, said actuating member dividing said housing into first and second chambers, said first chamber being in communication with the exhaust gases and said pressure pulsations during their increasing pressure phase of each amplitude causing the actuating member and pumping member to be moved through their first strokes, bleed hole means in said housing for communicating said second chamber to atmosphere, said second chamber and bleed hole means defining an air spring means for biasingly opposing movement of said actuating and pumping members through their first strokes and for effecting movement of the actuating and pumping members through their second strokes during the decreasing pressure phase of each amplitude of the pressure pulsations, said actuating member when at rest having a position spaced from one side of said bleed hole means, said exhaust gas pressure pulsations causing said actuating member to be reciprocated through strokes having a displacement such that said bleed hole means remains uncovered during low speed engine operation, through strokes having a displacement such that said bleed hole means is alternately covered and uncovered by said actuating member during medium speed operation of the engine and through strokes having a displacement wholly on the other side of said bleed hole means to at all times block communication between said second chamber and the atmosphere via said bleed hole means during high speed engine operation whereby said air spring means functions as a non-linear variable rate air spring means and said pump assembly is operable to pump said fluid during low engine speeds and loads when portions of the amplitude of the pressure pulsations are at subatmospheric pressure and during high engine speeds when the entire amplitude of the pressure pulsations are wholly above atmospheric pressure.

2. In combination, a vacuum pump assembly and an internal combustion engine which generates exhaust gases having pressure pulsations of varying pressure and amplitude at different engine speeds and with portions of the amplitude being at subatmospheric pressure at low engine speeds and with said amplitudes being wholly above atmospheric pressure at high engine speeds, said pump assembly comprising:

a vacuum pump means for pumping air from a vacuum source and including a reciprocable pumping member movable through first and second strokes, an actuating means including a housing and a reciprocable actuating member movable through first and second strokes and which is drivingly connected to said pumping member to move the same through its first and second strokes, said actuating member dividing said housing into first and second chambers, said first chamber being in communication with the exhaust gases and said pressure pulsations during their increasing pressure phase of each amplitude causing the actuating member and pumping member to be moved through their first strokes, bleed hole means in said housing for communicating said second chamber to atmosphere, said second chamber and bleed hole means defining an air spring means for biasingly opposing movement of said actuating and pumping members through their first strokes and for effecting movement of the actuating and pumping members through their second strokes during the decreasing pressure phase of each amplitude of the pressure pulsations, said actuating member when at rest having a position spaced from one side of said bleed hole means, said exhaust gas pressure pulsations causing said actuating member to be reciprocated through strokes having a displacement such that said bleed hole means remains uncovered during low speed engine operation, through strokes having a displacement such that said bleed hole means is alternately covered and uncovered by said actuating member during medium speed operation of the engine and through strokes having a displacement wholly on the other side of said bleed hole means to at all times block communication between said second chamber and the atmosphere via said bleed hole means during high speed engine operation whereby said air spring means functions as a variable rate air spring means and said pump assembly is operable to pump said air from said vacuum source during low engine speeds and loads when portions of the amplitude of the pressure pulsations are at subatmospheric pressure and during high engine speeds when the entire amplitude of the pressure pulsations are wholly above atmospheric pressure.

3. In combination, a vacuum pump assembly and an internal combustion engine which generates exhaust gases having pressure pulsations of varying pressure and amplitude at different engine speeds and with portions of the amplitudes being at subatmospheric pressure at low engine speeds and with said amplitudes being wholly above atmospheric pressure at high engine speeds, said pump assembly comprising:

double-acting pump means including a reciprocable pumping member movable through first and second strokes for pumping air from a vacuum source during each stroke, an actuating means including a housing and a reciprocable actuating member movable through first and second strokes and which is drivingly connected to said pumping member to move the same through its first and second strokes, said actuating member dividing said housing into first and second chambers, said first chamber being in communication with the exhaust gases and said pressure pulsations during their increasing pressure phase of each amplitude causing the actuating member and pumping member to be moved through their first strokes, bleed hole means in said housing for communicating said second chamber to atmosphere, said second chamber and bleed hole means defining an air spring means for biasingly opposing movement of said actuating and pumping members through their first strokes and for effecting movement of the actuating and pumping members through their second strokes during the decreasing pressure phase of each amplitude of the pressure pulsations, said actuating member when at rest having a position spaced from one side of said bleed hole means, said exhaust gas pressure pulsations causing said actuating member to be reciprocated through strokes adjacent one end of said housing and having a displacement such that said bleed hole means remains uncovered during low speed engine operation, through strokes having a displacement such that said bleed hole means is alternately covered and uncovered by said actuating member during medium speed operation of the engine and through strokes adjacent the other end of said housing and having a displacement wholly on the other side of said bleed hole means to at all times block communication between said second chamber and the atmosphere via said bleed hole means during high speed engine operation whereby said air spring means functions as a non-linear variable rate air spring means and said pump means of said pump assembly is operable to pump said air from said vacuum source during low engine speeds when portions of the amplitude of the pressure pulsations are at subatmospheric pressure and during high engine speeds when the entire amplitude of the pressure pulsations are wholly above atmospheric pressure.

4. In combination, a vacuum pump assembly and an internal combustion engine which generates exhaust gases having pressure pulsations of varying pressure and amplitude at different engine speeds and with portions of the amplitudes being at subatmospheric pressure at low engine speeds and with said amplitudes being wholly above atmospheric pressure at high engine speeds, said pump assembly comprising:

a double-acting pump means including a reciprocable pumping member movable through first and second strokes for pumping air from a vacuum source during each stroke, an actuating means including a housing and a reciprocable actuating member movable through first and second linear strokes and which is drivingly connected to said pumping member to move the same through its first and second strokes, said actuating member dividing said housing into first and second chambers, said first chamber being in communication with the exhaust gases and said pressure pulsations during their increasing pressure phase of each amplitude causing the actuating member and pumping member to be moved through their first strokes, bleed hole means in said housing for communicating said second chamber to atmosphere, said bleed hole means being located in a side of said housing and extending transversely of the linear stroke movement of said actuating member, said second chamber and bleed hole means defining an air spring means for biasingly opposing movement of said actuating and pumping members through their first strokes and for effecting movement of the actuating and pumping members through their second strokes during the decreasing pressure phase of each amplitude of the pressure pulsations, said actuating member when at rest having a position spaced from one side of said bleed hole means, said exhaust gas pressure pulsations causing said actuating member and pumping member to be reciprocated through strokes adjacent one end of said housing and pump means, respectively, and the actuating member having a displacement such that said bleed hole means remains uncovered during low speed engine operation, through strokes having a displacement such that said bleed hole means in said housing is alternately covered and uncovered by said actuating member during medium speed operation of the engine and through strokes adjacent the other end of said housing and pump means and having with the actuating member a displacement wholly on the other side of said bleed hole means to at all times block communication between said second chamber and the atmosphere via said bleed hole means during high speed engine operation whereby said air spring means functions as a non-linear variable rate air spring means and said pump means of said pump assembly is operable to primarily pump air from said vacuum source adjacent said one end of the pump means during low engine speeds when portions of the amplitude of the pressure pulsations are at subatmospheric pressure and to pump air from said vacuum source adjacent the other end of the pump means during high engine speeds when the entire amplitude of the pressure pulsations are wholly above atmospheric pressure.

* * * * *